US005316230A

United States Patent [19]

Focke et al.

[11] Patent Number: 5,316,230

[45] Date of Patent: May 31, 1994

[54] METHOD AND APPARATUS FOR JOINING THE ENDS OF WEBS OF PACKAGING MATERIAL

[75] Inventors: Heinz Focke, Verden; Jürgen Wach, Bremen, both of Fed. Rep. of Germany

[73] Assignee: Focke & Co. (GmbH & Co.), Verden, Fed. Rep. of Germany

[21] Appl. No.: 843,029

[22] Filed: Feb. 28, 1992

[30] Foreign Application Priority Data

Mar. 7, 1991 [DE] Fed. Rep. of Germany ..... 4107254

[51] Int. Cl.[5] ..... B65H 19/18

[52] U.S. Cl. ..... 242/58.1; 242/58.5

[58] Field of Search ..... 242/58.1, 58.4, 58.5

[56] References Cited

U.S. PATENT DOCUMENTS

| | | | |
|---|---|---|---|
| 3,024,157 | 3/1962 | Beerli | 242/58.1 |
| 3,995,791 | 12/1976 | Schoppee | 242/58.1 |
| 4,151,403 | 4/1979 | Woolston | 242/58.1 |
| 4,262,855 | 4/1981 | Haag | 242/58.1 |
| 4,645,558 | 2/1987 | Sato et al. . | |
| 4,722,489 | 2/1988 | Wommer | 242/58.1 |
| 4,757,951 | 7/1988 | Ludszeweit | 242/58.1 |
| 4,848,691 | 7/1989 | Muto et al. | 242/58.1 |
| 5,133,511 | 7/1992 | Mack et al. | 242/58.1 |
| 5,190,234 | 3/1993 | Ezekiel | 242/58.1 |

FOREIGN PATENT DOCUMENTS

| | | | |
|---|---|---|---|
| 117927 | 9/1984 | European Pat. Off. . | |
| 162371 | 5/1985 | European Pat. Off. . | |
| 179243 | 5/1985 | European Pat. Off. . | |
| 0251102 | 1/1988 | European Pat. Off. | 242/58.1 |
| 3527446 | 2/1987 | Fed. Rep. of Germany . | |
| 2916236 | 6/1989 | Fed. Rep. of Germany . | |
| 2123801 | 2/1984 | United Kingdom . | |
| 2148856 | 6/1985 | United Kingdom . | |

*Primary Examiner*—Thomas B. Will

*Attorney, Agent, or Firm*—Sughrue, Mion, Zinn, Macpeak & Seas

[57] ABSTRACT

When a web of packaging material is fed to a folding turret (11), it is intended to change the web of material when the reel is empty with as little manual labour as possible. For this purpose, there is provided a severing and connecting unit (17), in which a running-off web (15) is automatically severed and connected to a connecting web (16) which is held ready. In order to join the webs in the proper position, a marking (mark 43) of the running-web (15) is scanned while the conveying speed is greatly reduced. After the marking has been detected, the web is stopped and the severing cut is applied while it is simultaneously joined to the connecting web (16) which is held ready precisely in the proper position. During this change of webs, the folding turret (11) can continue to operate, if a sufficient web store is present. It is, however, also possible to employ a loop store (18) with a smaller capacity ana to stop the folding turret (11) or a blank unit (12) for producing blanks for a short period.

14 Claims, 7 Drawing Sheets

METHOD AND APPARATUS FOR JOINING THE ENDS OF WEBS OF PACKAGING MATERIAL

BACKGROUND OF THE INVENTION

The invention relates to a method of joining the ends of webs of material, especially of a running-off web of packaging material (running-off web) to the leading end of a new web (connecting web) of packaging material, in which during a phase of a temporary standstill of the running-off web, the latter is severed and a web end of the running-off web formed in this way is joined to a leading web end of the connecting web, for example by means of an adhesive tape. Furthermore, the invention relates to an apparatus for conducting the method.

In high-capacity packaging machines, the handling of the packaging material is particularly problematic. Efforts are made to avoid manual labour as much as possible.

Packaging material is mainly supplied in the form of wound webs of material, namely reels. When a reel of a running-off web is used up, the object is to join a new web with as few manual manipulations as possible. This is particularly problematic if the web is prepared for a specific position of the blanks which are made by being severed from the web. If the packaging material is printed with words or pictures which require a specific relative position within the blank, the severing cut has to be applied precisely between adjacent blanks.

SUMMARY OF THE INVENTION

The invention is based on the object to join the ends of webs of material with as little manual labour as possible, i.e. in a substantially automatized manner, while ensuring a precise severing cut in a given place.

To attain this object, the method according to the invention is characterized in that the position of the running-off web is scanned by means of markings on the web of material and the running-off web is halted (stopped) in response thereto and the severing cut is applied in a given position relative to the marking, and finally an end of the connecting web which fits the end of the running-off web is joined thereto in a required position.

Consequently, the method according to the invention operates with webs of (packaging) material which are provided with markings, especially printed marks arranged in accordance with the blanks which are to be made. Expediently, a marking is arranged in each region of a severing cut.

Moreover, the invention proceeds on the basis of a relatively high conveying or drawing speed of the web of material, for example 51 re/min. When the reel of the running-off web is nearly empty, the process of changing the webs is started. For this purpose, the speed of the running-off web is reduced. An appropriate scanning means (mark reader) now detects a mark and then the running-off web which is running at a very low speed is stopped. Thereafter, the severing cut is applied in the proper position relative to the mark. The connecting web has previously been (manually) prepared in good time for being joined to the running-off web. An end of the connecting web which fits the end of the running-off web with respect to the marking is placed against the end of the running-off web and is joined thereto. Subsequently, the drive of the web is restarted.

Expediently, a folding means for processing blanks made in the region of a blank unit is stopped at least temporarily while the webs are changed over. It would, however, also be possible to continue the operation of the folding unit (folding turret). In this case, a sufficient web store is formed before the change of webs is started.

The apparatus according to the invention is provided with a separate drive means for the web (running-off web) while it is driven at a substantially reduced conveying speed. This drive means follows in the conveying direction a severing and connecting unit which is provided for conducting the change of webs. As a result, the running-off web is drawn through this severing and connecting unit. The drive means is preferably in the form of a means for forming web loops (pivoting arm with loop rollers). In order to drive the running-off web at a reduced speed (of for example 0 to 2 m/min), this web-looping means is actuated so as to enlarge the web loops. According to a proposal of the invention, the web is first stopped for this purpose and then the separate drive is activated. In this process, the running-off web can be driven by loop-forming means movable under gravity, especially by means of an appropriate adjustment of the pivoting arm.

To apply the severing cut, the running-off web is immediately stopped in the region of the severing and connecting unit after a mark has been detected, particularly by means of a web brake (shoe brake) which presses the running-off web against a counter face, especially against a deflecting roller.

Further features of the invention relate to the structure of the reels for the webs, the structure of the severing and connecting unit and to the separate drive of the web of material during the change of webs.

An exemplary embodiment of the apparatus according to the invention will be described below in detail with reference to the drawings, in which:

DESCRIPTION OF A PREFERRED EMBODIMENTS

Figure 1:
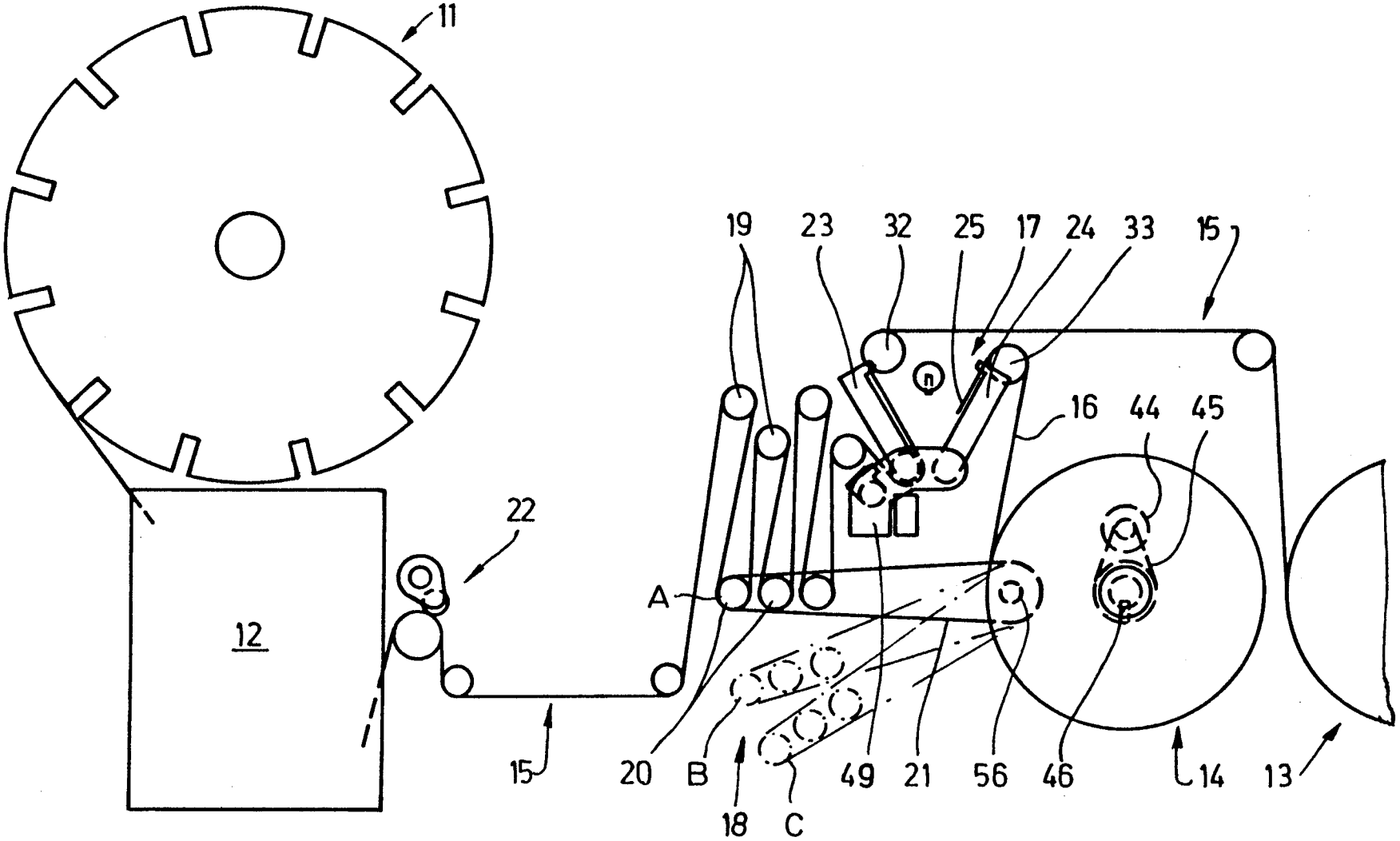
FIG. 1 is a schematic side view of part of a packaging machine.

The illustrated exemplary embodiment is concerned with the processing of a web of material made from thin packaging material, especially a foil. This foil is printed, particularly with words and/or pictures which have to appear on the packs made from the blanks in their proper position. The illustrated apparatus and the described method are particularly suitable for producing paper tissue packs.

In order to produce the packs, the web of material is fed to a folding unit, particularly a rotatably driven folding turret 11. A blank unit 12 is arranged upstream of the folding turret 11. Blanks are severed from the web of material within the blank unit 12 by means of a cutting unit and are then fed to the periphery of the folding turret 11. Preferably, the blank unit 12 is designed as described and illustrated in EP-A-365 812.

To ensure a continuous supply of packaging material to the folding turret 11, several reels, in the present case two reels, of wound webs of material are provided, particularly a running-off reel 13 and a connecting reel 14. The web of material which is fed to the folding turret 11 is continuously drawn off the running-off reel 13, particularly in the form of a running-off web 15. The other reel, i.e. the connecting reel 14, is prepared for being joined to the running-off web 15 when the running-off reel 13 is used up. A leading portion of a connecting web 16 of the connecting reel 14 is held ready in the proper position.

The respective running-off web 15 is passed through a severing and connecting unit 17 which is activated when the running-off reel 13 is nearly used up and the connecting web 16 has to be joined.

In the conveying direction, the severing and connecting unit 17 is followed by a web store, particularly a loop store 18. This store comprises a plurality of loop rollers 19 and 20 which are located opposite to one another in pairs. The web of material, that is to say the running-off web 15, is guided over the loop rollers 19, 20. The (lower) loop rollers 20 are adjustably arranged, particularly on a pivoting arm 21. By adjusting the pivoting arm 21 relative to the stationary loop rollers 19, the loop store 18 is either enlarged or reduced.

The web of material is drawn out of the loop store 18 and conveyed into the blank unit 12 by means of driven draw rollers 22. This main drive for the running-off web 15 is set to a relatively high conveying speed of approximately 50 re/min.

The severing and connecting unit 17 is designed similar to the web-joining apparatus according to EP-B-179 243. Two plate-like web holders 23 and 24 are pivotably mounted on a supporting frame. One of these web holders—in the illustrated exemplary embodiment the left hand web holder 23—serves for contacting and temporarily holding the running-off web 15. The end of the connecting web 16 is held ready at the confronting side of the web holder 24. This connecting end 25 is accurately oriented for a given division of the web of material. On their confronting sides, the plate-like web holders 23, 24 are provided with a holding surface for end portions of the running-off web 15 and the connecting web 16. In the present exemplary embodiment, a sheet-like coating piece 26, 27 made of an elastic material such as rubber is disposed on each web holder as a direct contact surface for the web of material. Suction bores 28, 29 are arranged approximately centrally relative to this coating piece 26, 27 and open out into the contact surface of the coating pieces 26, 27. In the present exemplary embodiment, there is provided a transversely directed row of several suction bores 28, 29 which serves for fixing end portions of the running-off web 15 and the connecting web 16.

Figure 2:
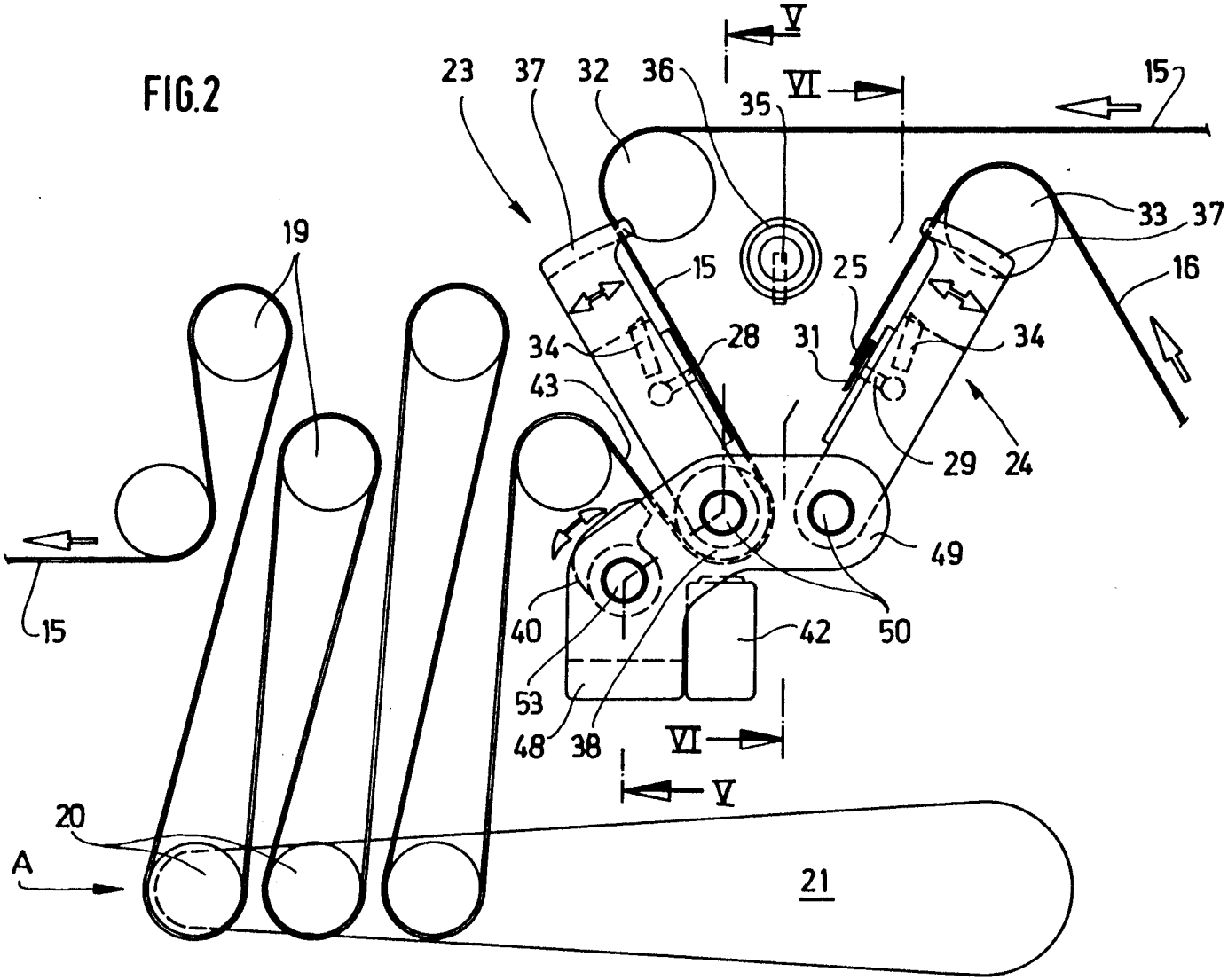
FIG. 2 shows a detail of FIG. 1, particularly a severing and connecting unit, on an enlarged scale.
Figure 3:
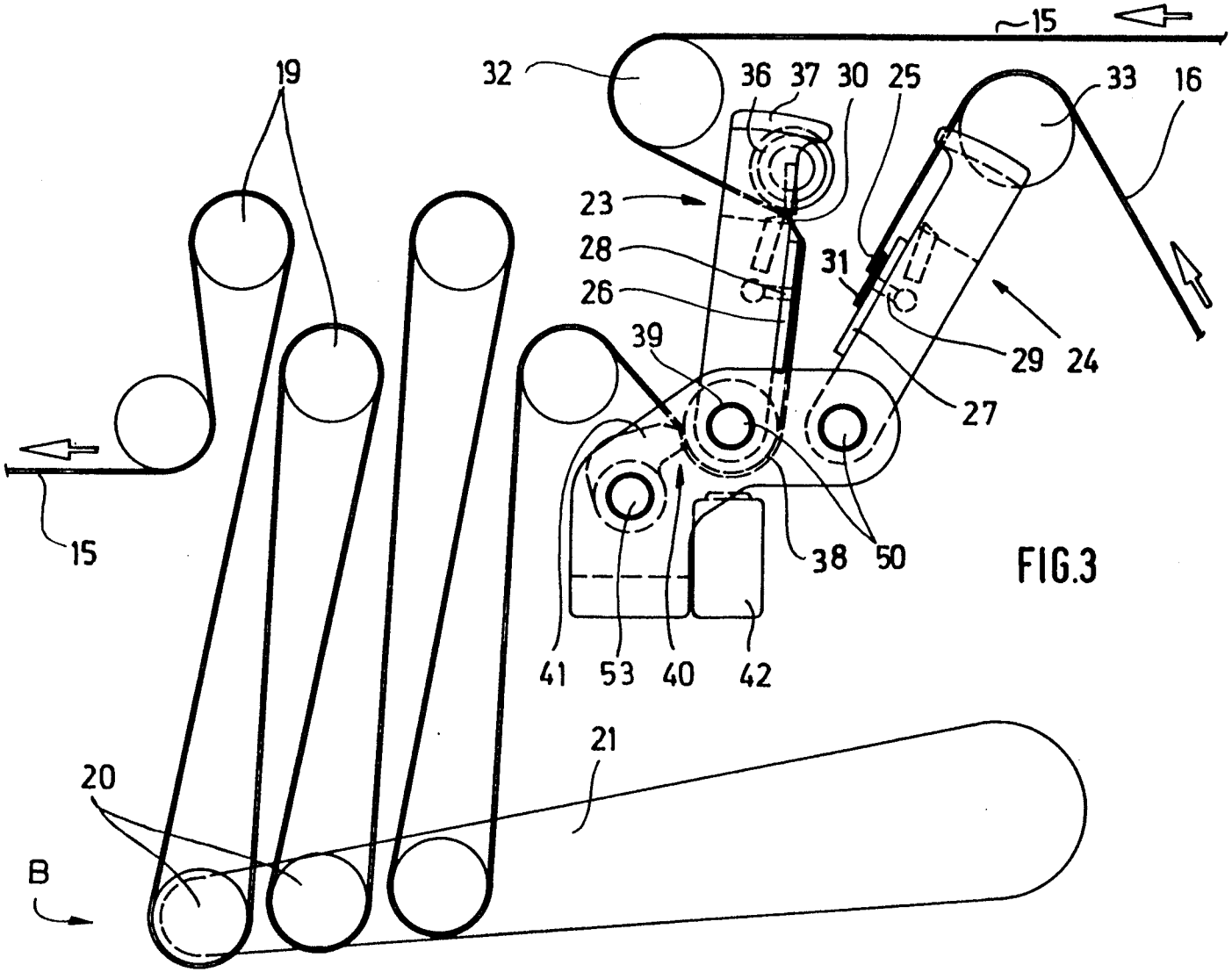
FIG. 3 shows the detail of FIG. 2, with a different relative position of means.

After the running-off reel 13 has been used up, an accurately positioned severing cut is applied to the running-off web 15. A running-off end 30 which is formed thereby is joined to the connecting end 25 in a precise relative position, particularly by means of a transversely directed adhesive tape 31. With a projecting portion, this adhesive tape 31 is already joined to the connecting end 25 of the connecting web 16 and is held in the accurate relative position on the web holder 24 by means of the suction bores 29 (FIG. 2 and FIG. 3). When the web ends 25 and 30 are joined, the latter is located in the region of the suction bores 28 on the web holder 23 in such a way that the free portion of the adhesive tape 31 can engage this running-off end 30 in order to join it to the connecting web 16. In the present exemplary embodiment, however, the ends are joined with an overlap of the running-off web 15.

For this purpose, the web holders 23, 24 are pivoted into a position in which the confronting faces or coating pieces 26, 27 abut one another. Thus, the running-off end 30 is joined to the free portion of the adhesive tape 31.

At the entry side, each web holder 23, 24 is associated with a deflecting roller 32, 33 for the running-off web 15 and the connecting web 16. The deflecting rollers 32, 33 are arranged such that in the initial position, the deflected webs are directly fed to the contact surfaces or coating pieces 26, 27 of the web holders 23, 24 (FIG. 2).

In order to severe the running-off web 15, the web holder which is assigned to this web 15—in this case web holder 23—is moved in a pivoting manner. As a result, a severing knife 34 which is attached to the web holder 23, 24 is moved past a stationary common counter knife 35, such that the severing cut is applied to the running-off web 15. The severing knife 34 is centrally arranged relative to the web holders 23, 24—in their initial position.

In order to accurately guide the web holders 23, 24 when the severing cut is applied, a stationary guide roller 36 is mounted in the region of the counter knife 35. A curved track 37 at each end of the web holders 23, 24 glides over this guide roller 36 in a supporting manner while the severing cut is applied (FIG. 3).

The webs of material, which in the illustrated exemplary embodiment are fed to the severing and connecting unit 17 from the right hand side, specifically running-off web 15 and connecting web 16, are always conveyed through between the two web holders 23, 24. In this embodiment, the further path of the web of material leads away from the reels 13, 14, i.e. to the left. When the web of material exits the region of the web holders 23, 24, it is guided over a lower deflecting roller 38 which is located in the region of the web holder 23 and is arranged equiaxially to a pivot bearing 39 of the web holder 23.

Further means assigned to the severing and connecting unit are a web brake, in the present case a shoe brake 40 with a pivotably mounted brake shoe 41. This brake shoe 41 contacts the deflecting roller 38 in order to temporarily stop the running-off web 15.

Figure 6:
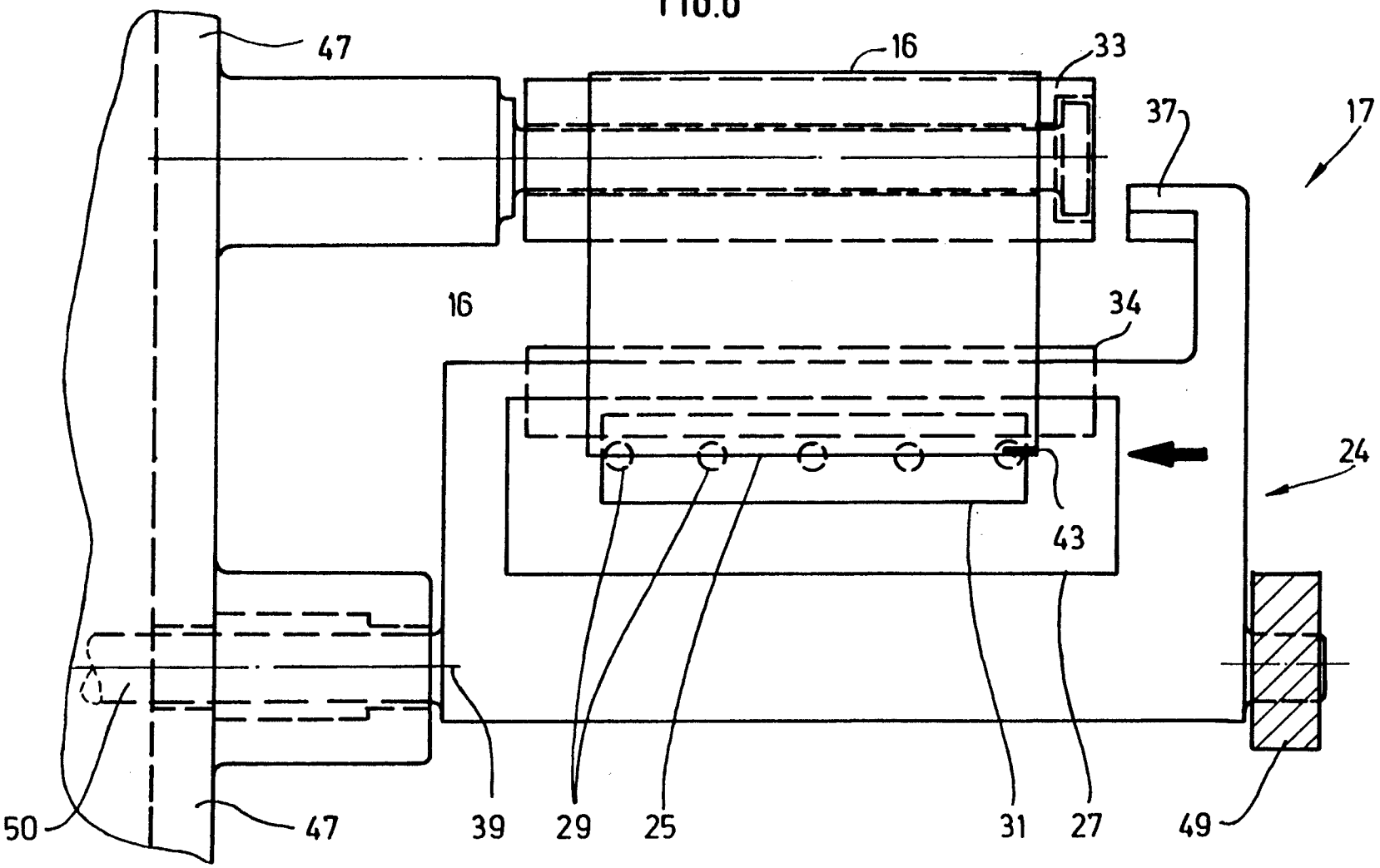
FIG. 6 is a section of the apparatus of FIG. 2, offset relative to FIG. 5 and taken along the line VI—VI.
Figure 7:
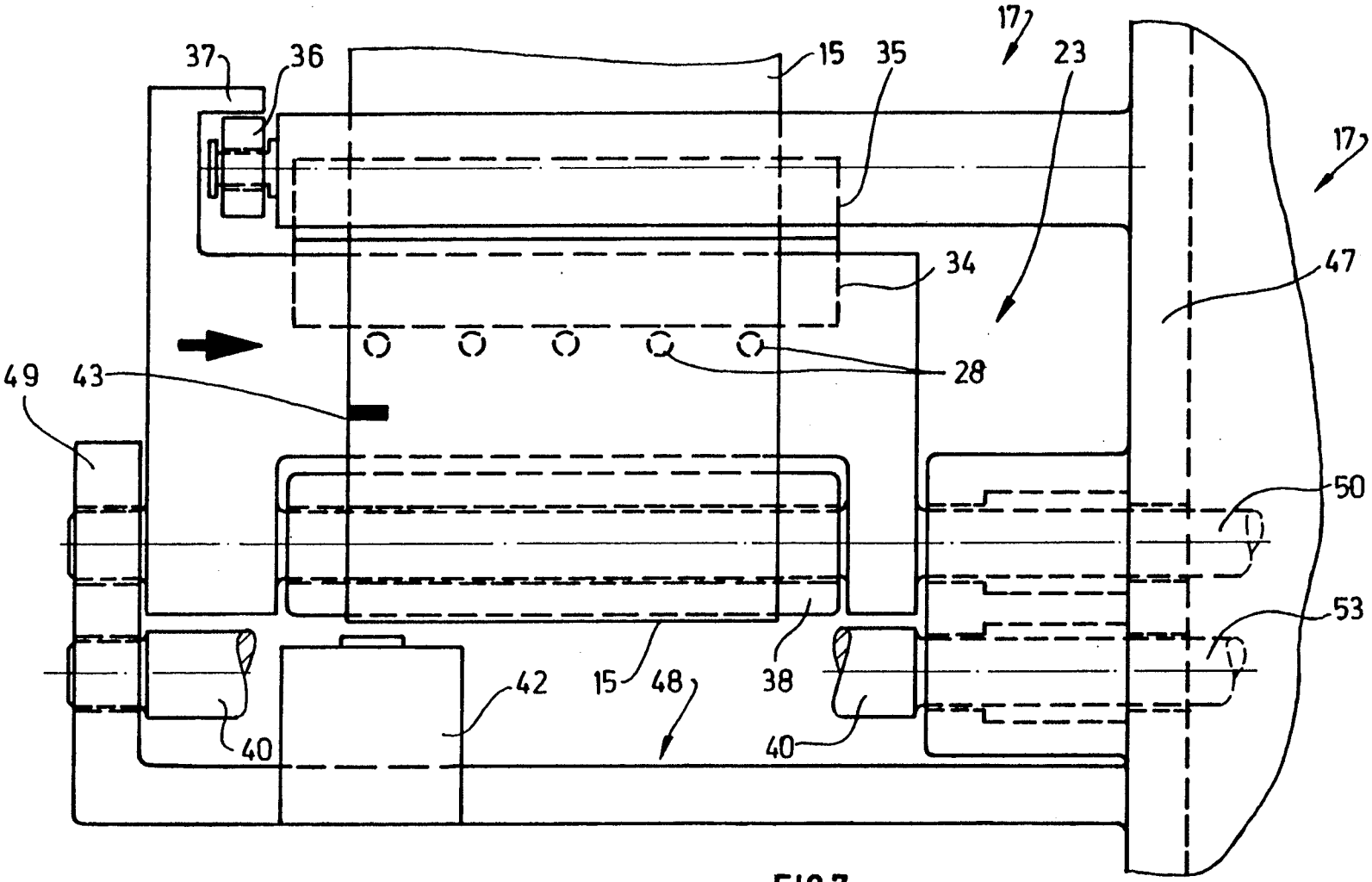
FIG. 7 is a view of the severing and connecting unit, transverse to FIG. 2 and FIG. 3.

A scanning means for scanning markings of the web of material, particularly a mark reader 42 for detecting marks 43 of the web of material, is also arranged in the region of the deflecting roller 38, particularly below said roller. The marks 43 are arranged on one of the longitudinal edges of the web of material (FIG. 6 and FIG. 7).

The apparatus which has been described in the foregoing can be operated in several ways. According to a preferred mode of operation, the residual stock of the running-off reel 13 is monitored. Expediently, the reels 13 and 14 are driven in order to support the drawing of the web. Each reel 13, 14, however, is associated with its own reel brake 44, specifically a hysteresis brake which acts on the reel shaft via an endless belt, particularly via a toothed belt 45.

Moreover, each reel 13, 14 is associated with a measuring device for measuring the residual quantity of wound web of material. In the present exemplary embodiment, this measuring device is a pulse counter 46 which monitors the number of revolutions of the reels 13, 14. When the rotational speed increases or when the running-off reel 13 reaches a predeterminable increased rotational speed, the change of webs is started. The monitoring of the running-off reel 13 takes into account that with a constant drawing-off speed of the running-off web 15, the rotational speed of the reel increases.

The pulse counter 46 acting as a means for counting the revolutions of the reels has a conventional design and comprises a pulse disk having openings or slits which is arranged on the axis of rotation of the reel 13, 14. A light source and a receiver are fixedly arranged on opposite sides of the pulse disk. The number of light signals received in a unit of time reveals the number of revolutions of the reel.

When the running-off reel 13 or the pulse counter 46 start the change of webs in the present embodiment, first of all the loop store 18 is adjusted. In particular, the pivoting arm 21 is moved from an (upper) starting position A to an intermediate position B (FIG. 1), thus enlarging the loop store 18. In this process, the reel brake 44 is (partially) released. Subsequently, the running-off web 15 is stopped over its entire length by means of a halt of the draw rollers 22.

Now, the phase of the significantly reduced conveying speed of the running-off web 15 in the region of the severing and connecting unit 17 begins. The running-off web 15 is driven by a separate drive unit, specifically by the loop-forming means, i.e. the pivoting arm 21, by means of moving the pivoting arm 21 into position C. In this process, the draw rollers 22 remain stopped. The running-off web 15 is slowly drawn through the severing and connecting unit 17 by the pivoting arm 21 until a mark 43 which is the next to follow is detected by the mark reader 42. The pivoting arm 21 can be moved into position C under gravity. A motor-operated drive would also be possible. The reel brake 44 is fully or partially released. If required, the motor-operated drive of the running-off reel 13 may also be activated.

The identification of a mark 43 by the mark reader 41 directly stops the running-off web 15 (again) in the region of the severing and connecting unit 17. For this purpose, the shoe brake 40 is actuated, so that the brake shoe 41 fixes the running-off web 15 on the deflecting roller 38. Immediately thereafter, the severing cut, which has a specific recurring position relative to the detected mark, is applied in the described way.

After the web ends (connecting end 25 and running-off end 30) have been joined in the described way, the web holders 23, 24 are moved back to their initial position. The web of material, i.e. the new running-off reel, is restarted.

There are different solutions regarding the operation of the folding turret 11 and the blank unit 12. The portion of the web of material which is directed towards the folding turret 11 and the blank unit 12 may already be restarted while the severing cut is applied and the web ends are joined. In this case, the web of material is taken from the loop store 18 until the web ends are joined and the new running-off reel is started. As a result of the reduction of the loop store 18, the pivoting arm 21 returns to the initial position A in this process.

Alternatively, a web store with a greater volume may additionally be assigned to the folding turret 11 or the blank unit 12. A sufficient quantity of web of material can be conveyed into this web store (not shown), before the change of webs is started. The complete process of changing the webs can in this case be conducted while the folding turret 11 and the blank unit 12 continue to operate.

An alternative way of operating the present severing and connecting unit 17 is to assign to this unit 17 a measuring device which measures the length by which the running-off web 15 is transported further after the triggering mark 43 has been detected by the mark reader 42. This length measuring device may be arranged in the form of a pulse counter in the region of the deflecting roller 38. The pulse counter is actuated—while the running-off web 15 is running at a low conveying speed—by the mark reader 42. Then, the pulse counter determines a residual conveying distance of the running-off web 15 until the shoe brake 40 is actuated in order to again stop the running-off web 15.

Figure 4:
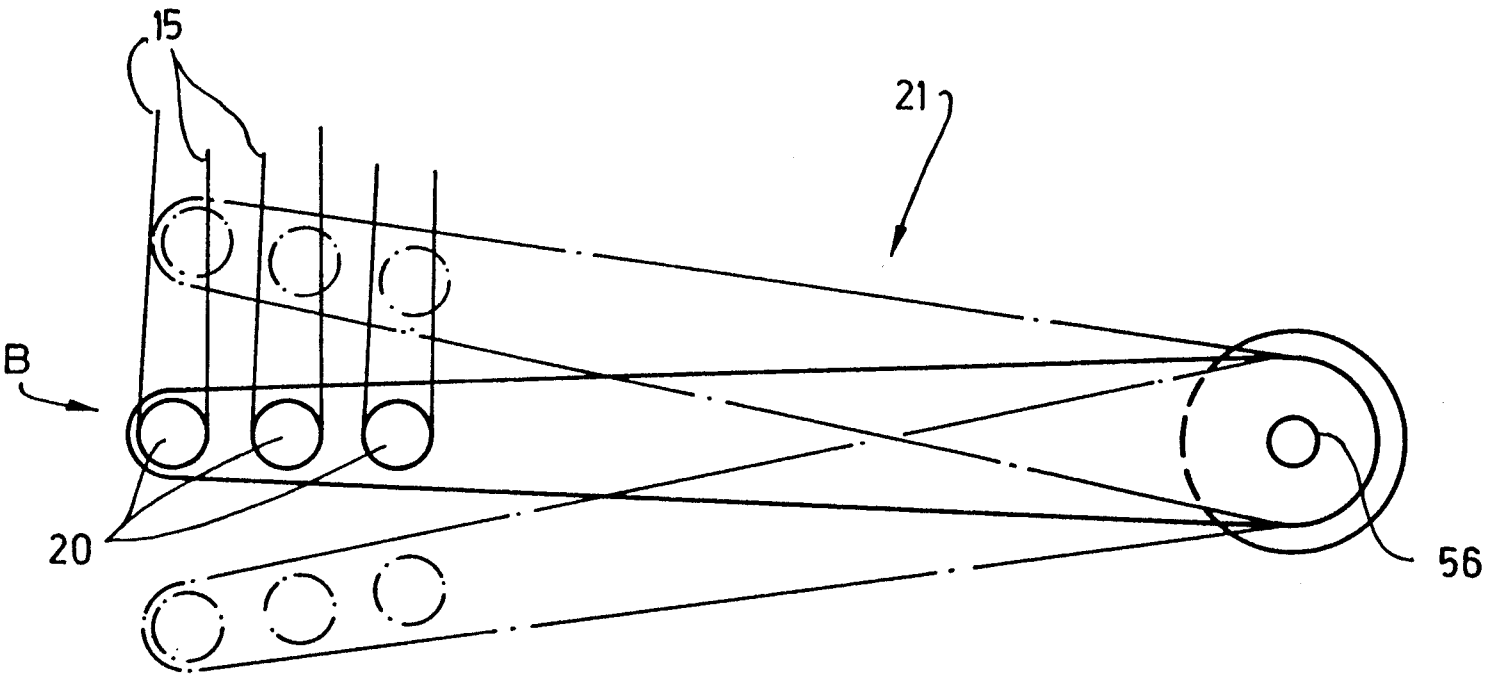
FIG. 4 is a detailed side view of a means for controlling the movement of the web (web-looping means)
Figure 5:
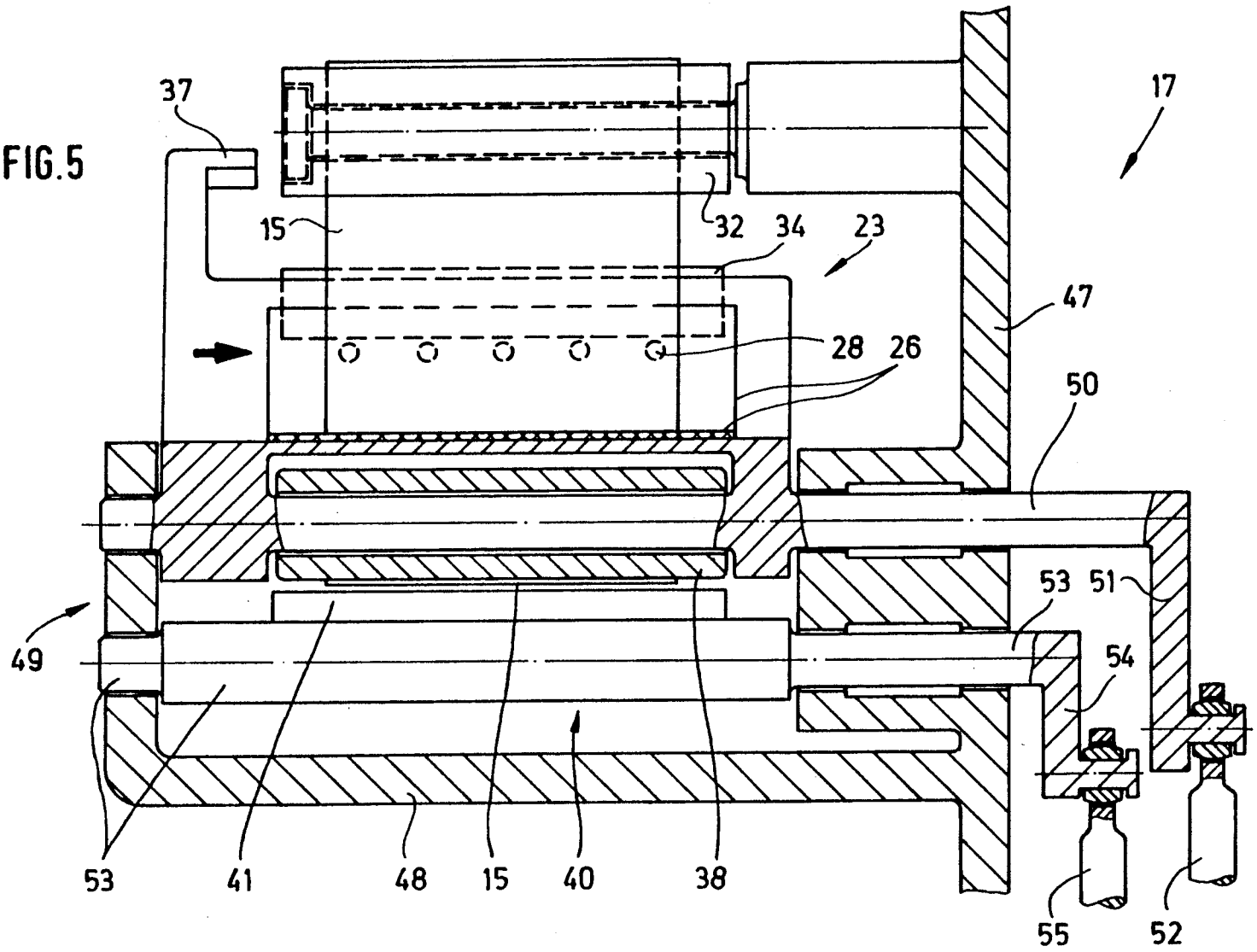
FIG. 5 is a section of the unit of FIG. 2, taken along the line V—V.

The loop store 18, that is to say the pivoting arm 21, at the same time serves in a conventional manner as a control means for the transport of the running-off web 15. The pivoting arm 21 measures the tension in the running-off web. For this purpose, a potentiometer is arranged in the region of a pivot bearing 56 of the pivoting arm 21. The tension measured by this potentiometer serves as a control signal for the drive or the deceleration of the respective running-off reel 13. As is evident from FIG. 4, pivoting movements within small amplitudes occur in positions A, B and C of the pivoting arm. These pivoting movements are a result of the control movements reacting to changes in the tension of the web.

The described means of the severing and connecting unit 17 are connected to a machine frame in a specific manner, particulary to a supporting wall 47 of said frame. An angular supporting arm 48 is attached to this supporting wall 47 and comprises a supporting leg 49 located in parallel to the supporting wall 47. Supporting wall 47 and supporting arm 48 serve for mounting the movable means of the severing and connecting unit 17, particularly, on the one hand, the pivotable web holders 23 and 24 and, on the other hand, the movable shoe brake 40. The mark reader 42 is also connected to said supporting frame, particularly to the supporting arm 48. Preferably, the mark reader 42 is adjustably arranged, for example in long holes. As a result, the mark reader can be adjusted or precisely set to the required residual conveying length preceding the severing cut and is also adjustable to different formats of the blanks to be made and therewith to different distances between the marks. The web holders 23, 24 are rotatably mounted with actuating shafts 50 in, on the one hand, the supporting wall 47 and, on the other hand, the supporting leg 49.

The actuating shaft 50 of the two web holders 23, 24 is extended in the region of the supporting wall 47. A transversely directed actuating arm 51 is attached to a free end of each actuating shaft 50. This actuating arm 51 is linked to a connecting rod 52 which is operated by a drive means, for example a pressure medium cylinder.

Both web holders 23, 24 can be controlled and moved independently of one another by these actuating means. In this regard, there is no need for manual labour. Accordingly, the web holders 23, 24 are actuated mechanically or automatically or by means of other actuating means. Only the accurate positioning of the connecting end 25 and adhesive tape 31 on the respective web holder 24 is conducted by hand.

A corresponding drive is provided for the shoe brake 40. Said brake 40 is also pivotably mounted with an actuating shaft 53 in the supporting wall 47 and the supporting leg 49. A transversely directed actuating arm 54 is linked to a connecting rod 55. A pressure medium cylinder can also be employed in this case for moving the shoe brake 40.

We claim:

1. A method of joining a trailing, running-off end (30) of a running-off web (15) of packaging material to a leading, connecting end (25) of a connecting web (16) of packaging material, in which, during a phase of a temporary standstill of the running-off web (15), the running-off web (15) is severed and the resulting running-off end (30) of the running-off web (15) is joined to the connecting end (25) of the connecting web (16), characterized in that: the position of the running-off web (15) is scanned, by means of markings (43) which are arranged on the running-off web (15) at equal distances, to cause the running-off web (15) to be stopped; a severing cut is subsequently applied in a given position relative to a marking (43); and finally the connecting end (25) of the connecting web (16) is joined to the trailing end (30) of the running-off web (15) in a required position;

wherein the length of the running-off web (15), which is conveyed after identification of a marking (43) of the running-off web (15) and until the standstill for applying the severing cut, is measured by a revolution indicator of a rotating means, in the form of a deflecting roller (38) of the running-off web (15), located in the region of a severing and connecting unit (17).

2. The method as claimed in claim 1, wherein the running-off web (15) is slowed down to a very low conveying speed in order to scan the marking (43) and wherein after a marking (43) has been scanned, the running-off web (15) is stopped, either immediately or after a precise residual conveying distance, in order to apply the severing cut.

3. The method as claimed in claim 1, wherein a complete conveying portion of the or running-off web (15)—including a portion thereof which is directed towards a folding turret (11)—is temporarily stopped in order to apply the severing cut, in communication with the identification of the marking (43) which determines the severing cut.

4. The method as claimed in claim 3, wherein the folding turret (11) continues to operate without interruption while the ends of the running-off web (15) and connecting web (16) are joined, and wherein, for the production of blanks for the folding turret (11), the running-off web (15) is taken from a previously formed web store.

5. The method as claimed in claim 3, wherein a portion of the running-off web (15), which is directed towards the folding turret (11) or a blank unit (12) for producing the blanks, is restarted during the standstill for applying the severing cut, and wherein web material is taken from a store (18).

6. The method as claimed in claim 1, wherein a process of changing the webs is started in response to a residual quantity of the running-off web (15) on a reel (13) of the running-off web (15), and wherein the residual quantity on the reel (13) is measured by means of a revolution indicator of the reel (13).

7. The method as claimed in claim 1, wherein the running-off end (30) of the running-off web (15) and the connecting end (25) of the connecting web (16) are joined to one another with an overlap.

8. An apparatus for joining the ends of a running-off web (15) and a connecting web (16) which is to be connected thereto in the region of a severing and connecting unit (17), wherein a severing cut is applied during a temporary standstill of the running-off web (15) in order to form a trailing running-off end (30) which is to be joined to a prepared leading connecting end (25) of the connecting web (16), said apparatus comprising a mark reader (42) for detecting marks (43) which are arranged on the webs at equal distances; and severing means (34, 35) which is associated with the severing and connecting unit and which is controllable by the mark reader (42);

wherein the running-off web (15), in order to scan a mark (43) by means of the mark reader (42), is movable by a separate drive means at a significantly reduced conveying speed of the running-off web (15), said drive means forming web loops and being movable to slowly draw the running-off web (15) through the severing and connecting unit (17).

9. The apparatus as claimed in claim 8, wherein the mark reader (42) is adjustably arranged in the region of a deflecting roller (38) of the running-off web (15).

10. The apparatus as claimed in claim 8, wherein the severing and connecting unit (17) comprises two plate-like web holders (23, 24) for, on the one hand, the running-off end (30) of the running-off web (15) and, on the other hand, the connecting end (25) of the connecting web (16), and wherein said web holders (23, 24) are arranged in a V-like manner relative to one another in an initial position and comprise coating pieces (26, 27) for the web of material to rest against, which coating pieces (26, 27) are made of an elastic material and comprise suction bores (28, 29) opening out into the region of the coating pieces.

11. The apparatus as claimed in claim 10, wherein the web holders (23, 24), which are pivotable about stationary axles or actuating shafts (50), are actuable by a control gear comprising pivoting means which are linked to the actuating shafts (50) of each web holder (23, 24).

12. The apparatus as claimed in claim 8, wherein a running-off reel (13) and a connecting reel (14) comprise a residual-quantity monitoring means, including a revolution indicator (46), which in the case of a minimum residual quantity of web of material on the running-off reel (13) starts a process of changing the webs.

13. An apparatus for joining the ends of a running-off web (15) and a connecting web (16) which is to be connected thereto in the region of a severing and connecting unit (17), wherein a severing cut is applied during a temporary standstill of the running-off web (15) in order to form a trailing running-off end (30) which is to be joined to a prepared leading connecting end (25) of the connecting web (16), said apparatus comprising a mark reader (42) for detecting marks (43) which are arranged on the webs at equal distances; and severing means (34, 35) which is associated with the severing and connecting unit and which is controllable by the mark reader (42);

wherein a web shoe brake (40) which is controllable by the mark reader (42) is assigned to the running-off web (15) in the region of the severing and connecting unit (17), and by means of which an end portion of the running-off web (15) is fixable, after a mark has been detected, by means of a brake shoe (41) contacting a deflecting roller (38) for the running-off web (15).

14. The apparatus as claimed in claim 13, where in the shoe brake (40) is actuable by a control gear, by means of a rotation of an actuating shaft (53) on which the shoe brake (40) or its brake shoe (41) is mounted.

* * * * *